US007337647B2

(12) United States Patent
Shimomura et al.

(10) Patent No.: US 7,337,647 B2
(45) Date of Patent: Mar. 4, 2008

(54) GEAR AND METHOD AND DEVICE FOR MANUFACTURING THE GEAR

(75) Inventors: Mitsuhiko Shimomura, Nagoya (JP); Junichi Ooka, Nagoya (JP)

(73) Assignee: O-Oka Corporation, Nagoya-shi (JP)

( * ) Notice: Subject to any disclaimer, the term of this patent is extended or adjusted under 35 U.S.C. 154(b) by 68 days.

(21) Appl. No.: 11/078,457

(22) Filed: Mar. 14, 2005

(65) Prior Publication Data

US 2005/0257590 A1 Nov. 24, 2005

(30) Foreign Application Priority Data

Mar. 12, 2004 (JP) ..... 2004-071747

(51) Int. Cl.
*B21D 22/00* (2006.01)
*B21D 53/28* (2006.01)

(52) U.S. Cl. ..... 72/359; 72/356; 29/893.34

(58) Field of Classification Search ..... 72/359, 72/358, 354.2, 353.2, 356; 29/893.34
See application file for complete search history.

(56) References Cited

U.S. PATENT DOCUMENTS 3,028,662 A 4/1962 Pessl et al.
3,258,834 A 7/1966 Rork
4,111,031 A * 9/1978 Vennemeyer et al. ..... 72/359
5,295,382 A 3/1994 Fuhrman
6,279,366 B1 * 8/2001 Sakaguchi ..... 72/102
6,343,497 B2 * 2/2002 Hasegawa ..... 72/102

FOREIGN PATENT DOCUMENTS

EP 1 524 043 A2 4/2005
FR 2 763 267 11/1998

* cited by examiner

*Primary Examiner*—Derris H. Banks
*Assistant Examiner*—Teresa M. Bonk
(74) *Attorney, Agent, or Firm*—Oblon, Spivak, McClelland, Maier & Neustadt, P.C.

(57) ABSTRACT

A method for manufacturing a gear, wherein the gear is formed on a forging process by a die having an inner peripheral surface. A plurality of top surfaces corresponding to a bottom surface of the gear and both projected side surfaces corresponding to tooth surfaces of the gear and sandwiching the top surface connect smoothly to each other. The tooth surfaces and the bottom surface of the formed gear connect to each other smoothly. The forging process is carried out as a hot forging process in which the gear is formed by a hot forging die, or the forging process is carried out as a cold forging process in which the gear is formed by a cold forging die.

11 Claims, 15 Drawing Sheets

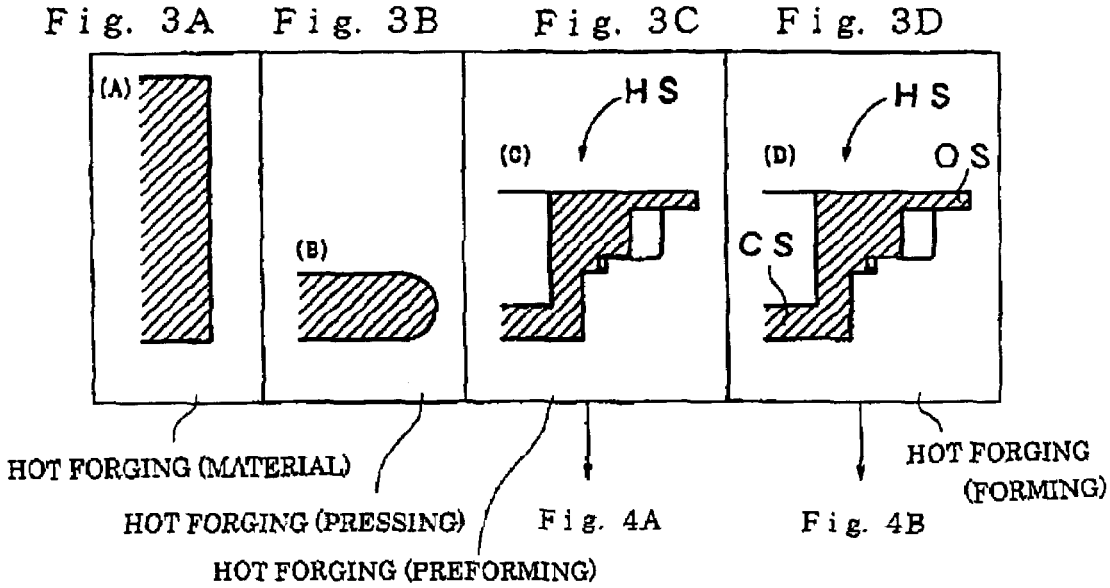
Fig. 3A
Fig. 3B
Fig. 3C
Fig. 3D
(A)
(B)
(C)
(D)
HS
HS
OS
CS
HOT FORGING (MATERIAL)
HOT FORGING (PRESSING)
HOT FORGING (PREFORMING)
Fig. 4A
Fig. 4B
HOT FORGING (FORMING)
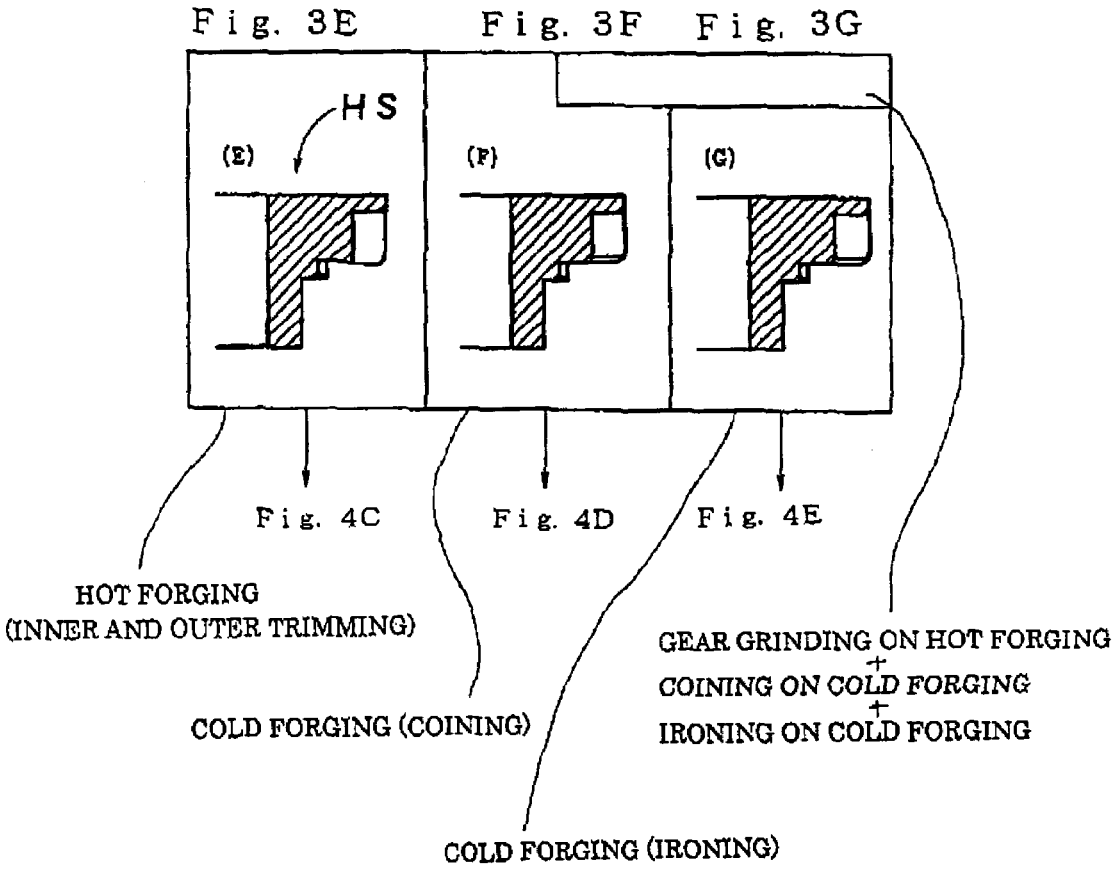
Fig. 3E
Fig. 3F
Fig. 3G
HS
(E)
(F)
(G)
Fig. 4C
Fig. 4D
Fig. 4E
HOT FORGING
(INNER AND OUTER TRIMMING)
COLD FORGING (COINING)
COLD FORGING (IRONING)
GEAR GRINDING ON HOT FORGING
+
COINING ON COLD FORGING
+
IRONING ON COLD FORGING Fig. 6A Fig. 6B Fig. 6C Fig. 6D
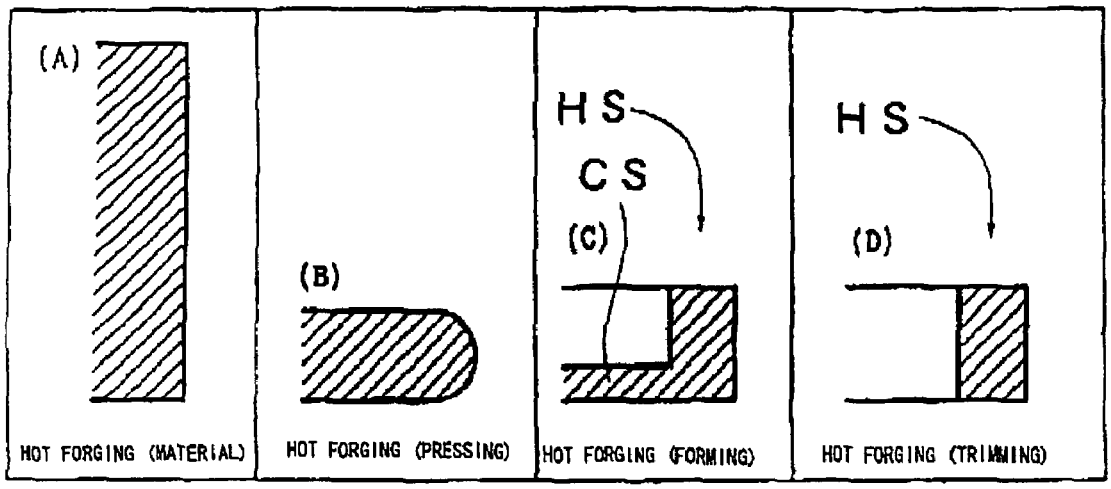
GEAR GRINDING ON HOT FORGING
+
COINING ON COLD FORGING
+
IRONING ON COLD FORGING
Fig. 6E Fig. 6F Fig. 6G
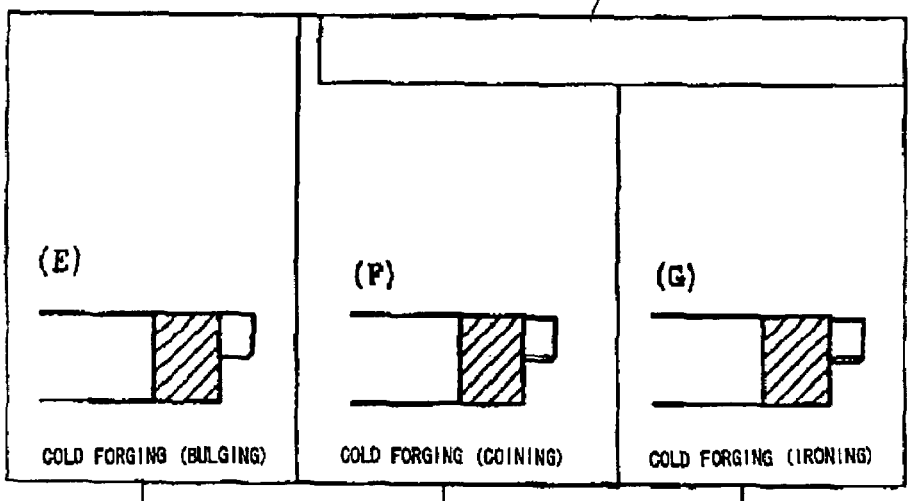
Fig. 7A Fig. 7B Fig. 7C Fig. 9A Fig. 9B Fig. 9C Fig. 9D
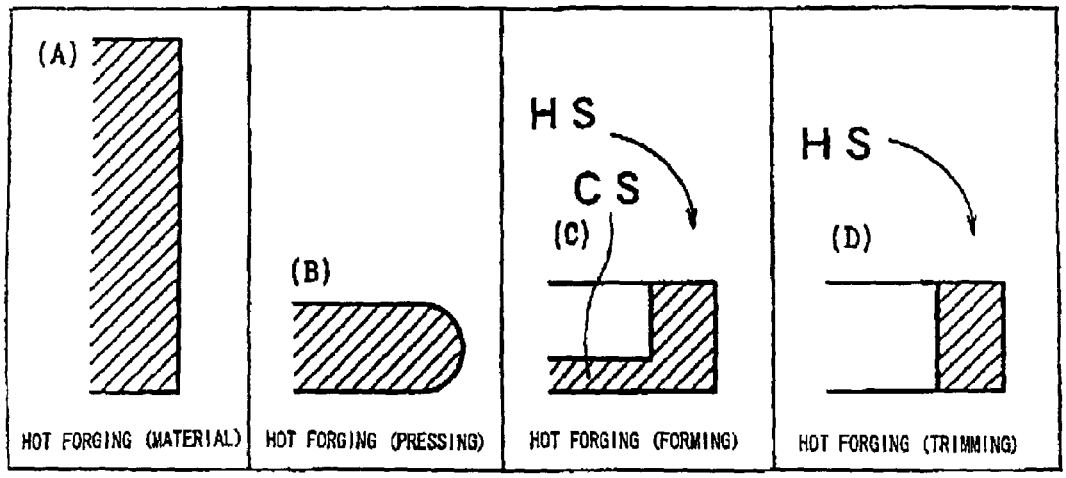
PREFORMING ON HOT FORGING
+
EXTRUDING ON COLD FORGING
+
COINING ON COLD FORGING
+
IRONING ON COLD FORGING
Fig. 9E Fig. 9F Fig. 9G
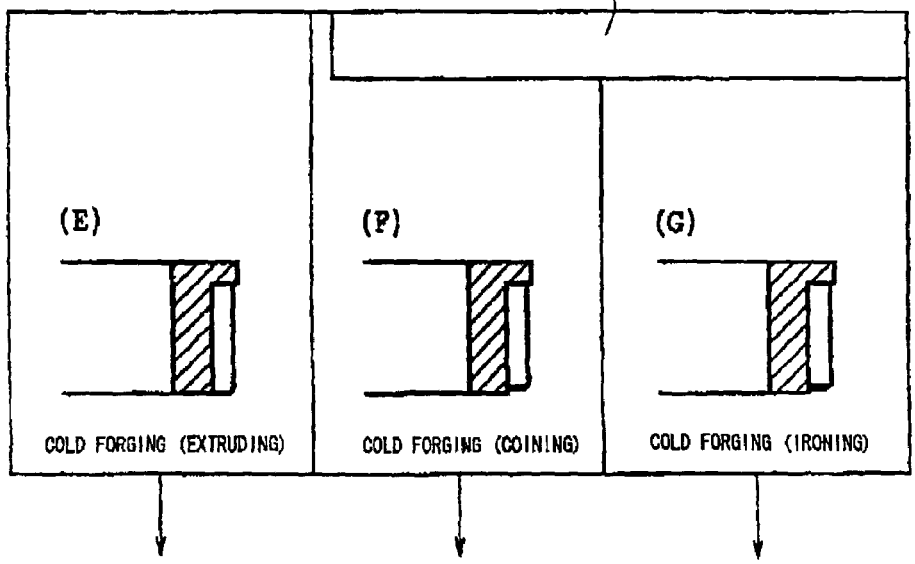
Fig. 10A Fig. 10B Fig. 10C

GEAR AND METHOD AND DEVICE FOR MANUFACTURING THE GEAR

BACKGROUND OF THE INVENTION

1. Field of the Invention

The present invention relates to a gear, a method and a device for manufacturing a gear, wherein the gear is formed on a forging process by a die having an inner peripheral surface, on which a plurality of top surface corresponding to a bottom surface of the gear and both projected side surfaces corresponding to tooth surfaces thereof and sandwiching the top surface, wherein the plurality of top surface and the both projected side surfaces of the die connect smoothly each others and wherein the tooth surfaces and the bottom surface of the formed gear connect to each other smoothly. The formed gear has the property of high intensity at a tooth root thereof and wide effective area of tooth form.

2. Related Art

In a conventional method for manufacturing a gear, as shown in FIG. 15, a primary material was formed by hot forging and a surface of the formed material was shaped on a lathe. Then, a gear is cut on the surface thereof by a gear hobbing machine and the cut gear is finished by shaving, or the gear is finished by gear grinding machine or honing machine after heat treating the cut gear.

SUMMARY OF THE INVENTION

In the above described conventional method for manufacturing a gear, there was a problem that when a gear formed by hobbing is finished by shaving or gear grinding and so on, a step is formed at R part of a root of tooth by the above finishing, and it lowers the intensity of the gear at the root of tooth.

Moreover, in the case that the R part of the tooth root on the gear is finished by an expensive gear grinding machine, there was a problem that it made manufacturing costs expensive.

Recently, in the case a gear is manufactured by forging, the forged gear is finished by shaving or gear grinding. Then, there were problems that a step is formed at a root of the tooth and in result, it made simularly manufacturing costs expensive. The present invention relates to a method for manufacturing a gear having no step at a tooth root and having the high intensity thereof inexpensively.

It is an object of the present invention to provide a method for manufacturing a gear in which it is able to prevent intensity of tooth root lowering and to attain to lower costs of products and manufacturing costs.

It is another object of the present invention to provide a gear, a method and a device for manufacturing a forged gear in which a tooth surface is connected to a bottom smoothly.

It is a further object of the present invention to provide a method for manufacturing a gear in which a tooth surface and a bottom connected to each other smoothly are formed on forging process without finishing process generating a step.

It is a still further object of the present invention to provide a method for manufacturing a gear on a forging process by a die having an inner peripheral surface on which a plurality of top surface and both projected side surfaces connect smoothly each other.

It is a still further object of the present invention to provide a method for manufacturing a gear in which the gear is formed on a forging process by a die having an inner peripheral surface, on which a plurality of top surface corresponding to a bottom surface of the gear and both projected side surfaces corresponding to tooth surfaces thereof and sandwiching the top surface connected smoothly each other, in which the plurality of top surface and the both projected side surfaces of the forged gear connect smoothly each other.

It is another object of the present invention to provide a method for manufacturing a gear, in which the gear is formed on a forging process by a die having an inner peripheral surface, on which a plurality of top surface corresponding to a bottom surface of the gear and both projected side surfaces corresponding to tooth surfaces thereof and sandwiching the top surface connect smoothly each other, and in which the tooth surfaces and the bottom surface of the formed gear connect to each other smoothly.

It is a further object of the present invention to provide a method for manufacturing a gear according to the first aspect, in which the forging process is carried out on hot forging process in which the gear is formed by the die having the inner peripheral surface including a plurality of the top surface corresponding to the bottom surface of the gear and both projected side surfaces corresponding to the tooth surfaces thereof and sandwiching the top surface.

It is a still further object of the present invention to provide a method for manufacturing a gear according to the first aspect, in which the forging process is carried out on cold forging process in which the gear is formed by the die having the inner peripheral surface including a plurality of the top surface corresponding to the bottom surface of the gear and both projected side surfaces corresponding to the tooth surfaces thereof and sandwiching the top surface.

It is a yet further object of the present invention to provide a method for manufacturing a gear according to the second aspect, in which the forging process is carried out by preforming in hot forging.

It is another object of the present invention to provide a method for manufacturing a gear according to the third aspect, in which the forging process is carried out by extrusion in cold forging.

It is a further object of the present invention to provide a method for manufacturing a gear according to the third aspect, in which the forging process is carried out by bulging in cold forging.

It is a still further object of the present invention to provide a method for manufacturing a gear according to the first aspect, in which a convex curved surface on the tooth surface of the gear is formed on the forging process by the die having a concave shape formed at a corresponding part on the projected side surface.

It is a yet further object of the present invention to provide a method for manufacturing a gear according to the seventh aspect, in which a flat curved surface on the convex curved tooth surface of the gear is formed by punching on the forging process by the die having a flat curved surface formed at a corresponding part thereon.

It is another object of the present invention to provide a method for manufacturing a gear according to the first aspect, in which an under cut part on the bottom of the gear is formed on the forging by the die having a top surface formed at a corresponding part thereon.

It is a further object of the present invention to provide a method for manufacturing a gear according to the first aspect, in which the both projected side surfaces of the die corresponding to the tooth surface of the gear formed by forging are formed respectively along an involute curve.

It is a still further object of the present invention to provide a method for manufacturing a gear according to the tenth aspect, in which the top surface of the die corresponding to the bottom of the gear formed by forging is formed along at least one selected from group of the trochoid curve, arc shape and the combination of the straight shape and arc shape.

It is a yet further object of the present invention to provide a gear manufactured by forging, in which the gear is formed on a forging process by the die having the inner peripheral surface, on which the plurality of a top surface corresponding to a bottom surface of the gear and both projected side surfaces corresponding to tooth surfaces thereof and sandwiching the top surface connect smoothly each other, and in which the formed gear has the tooth surfaces and the bottom surface which connect to each other smoothly.

It is another object of the present invention to provide a device for manufacturing a gear according to the present invention, in which the gear is formed on the forging process by the die having the inner peripheral surface, on which a plurality of the top surface corresponding to a bottom surface of the gear and both projected side surfaces corresponding to tooth surfaces thereof sandwiching the top surface connect smoothly each other, and in which the gear having the tooth surface and the bottom which connected to each other smoothly is manufactured.

In a method for manufacturing a gear according to the present invention, in which the gear is formed on a forging process by a die having an inner peripheral surface, on which a plurality of top surface corresponding to a bottom surface of the gear and both projected side surfaces corresponding to tooth surfaces thereof and sandwiching the top surface connect smoothly each other, and in which the tooth surfaces and the bottom surface of the formed gear connect to each other smoothly. Therefore, it is able to prevent an intensity of the tooth root lowering and to attain to lower costs of products and manufacturing costs.

In a method for manufacturing a gear of the present invention according to the first aspect, the forging process is carried out on hot forging process in which the gear is formed by the die having the inner peripheral surface including a plurality of the top surface corresponding to the bottom surface of the gear and both projected side surfaces corresponding to the tooth surfaces thereof and sandwiching the top surface. Therefore, it is able to prevent an intensity of the tooth root lowering and to attain to lower costs of products and manufacturing costs.

In a method for manufacturing a gear of the present invention according to the first aspect, the forging process is carried out on cold forging process in which the gear is formed by the die having the inner peripheral surface including a plurality of the top surface corresponding to the bottom surface of the gear and both projected side surfaces corresponding to the tooth surfaces thereof and sandwiching the top surface. Therefore, it is able to prevent an intensity of the tooth root lowering and to attain to lower costs of products and manufacturing costs.

In a method for manufacturing a gear of the present invention according to the second aspect, the forging process is carried out by preforming in hot forging. Therefore, it is able to prevent an intensity of the tooth root lowering and to attain to lower costs of products and manufacturing costs.

In a method for manufacturing a gear of the present invention according to the third aspect, the forging process is carried out by extrusion in cold forging. Therefore, it is able to prevent an intensity of tooth root lowering and to attain to lower costs of products and manufacturing costs.

In a method for manufacturing a gear of the present invention according to the third aspect, the forging process is carried out by bulging in cold forging. Therefore, it is able to prevent an intensity of tooth root lowering and to attain to lower costs of products and manufacturing costs.

In a method for manufacturing a gear of the present invention according to the first aspect, a convex curved surface on the tooth surface of the gear is formed on the forging process by the die having a concave shape formed at a corresponding part on the projected side surface. Therefore, it is able to obtain a high density and a relative roughness of the tooth surface by pressing the tooth surface on the forging.

In a method for manufacturing a gear of the present invention according to the seventh aspect, a flat curved surface is formed by punching or hammering the convex curved tooth surface of the gear on the forging process by the die having a flat curved surface formed at a corresponding part thereon. Therefore, it is achived to obtain a high density and a relative surface roughness of the flat curved tooth surface.

In a method for manufacturing a gear of the present invention according to the first aspect, an under cut part on the bottom of the gear is formed on the forging by the die having a top surface formed at a corresponding part thereon. Therefore, in the case the forged gear is processed by machining as after processing, there is no remained step formed at the tooth root.

In a method for manufacturing a gear of the present invention according to the first aspect, the both projected side surfaces of the die corresponding to the tooth surface of the gear formed by forging are formed respectively along the involute curve. Therefore, it is able to manufacture the gear having the involute curved tooth surface.

In a method for manufacturing a gear of the present invention according to the tenth aspect, the top surface of the die corresponding to the bottom of the gear formed by forging is formed along at least one selected from group of the trochoid curve, arc shape and the combination of the straight shape and arc shape. Therefore, it is able to manufacture the gear having the bottom formed along at least one selected from group of the trochoid curve, arc shape and the combination of the straight shape and arc shape.

In a gear manufactured by forging, in which the gear is formed on a forging process by the die having the inner peripheral surface, on which the plurality of a top surface corresponding to a bottom surface of the gear and both projected side surfaces corresponding to tooth surfaces thereof and sandwiching the top surface connect smoothly each other, and in which the formed gear has the tooth surfaces and the bottom surface which connect to each other smoothly. Therefore, it is able to enhance the intensity of the tooth root and to attain to lower costs of products.

In a device for manufacturing a gear according to the present invention, in which the gear is formed on the forging process by the die having the inner peripheral surface, on which the plurality of the top surface corresponding to a bottom surface of the gear and both projected side surfaces corresponding to tooth surfaces thereof sandwiching the top surface connect smoothly each other, and in which the gear having the tooth surface and the bottom connected to each other smoothly is manufactured. Therefore, it is able to prevent intensity of tooth root lowering and to attain to lower costs of products and manufacturing costs.

BRIEF DESCRIPTION OF THE DRAWINGS

FIGS. 3A, 3B, 3C, 3D, 3E, 3F and 3G are explanation views showing each step in the method for manufacturing the gear according to the first embodiment;

FIGS. 6A, 6B, 6C, 6D, 6E, 6F and 6G are explanation views showing each processes in the method for manufacturing the gear according to the second embodiment of the present invention;

FIGS. 9A, 9B, 9C, 9D, 9E, 9F and 9G are explanation views showing each processes on the gear and the method and device for manufacturing the same according to the third embodiment of the present invention;

DESCRIPTION OF THE PREFERRED EMBODIMENTS

Figure 1A:
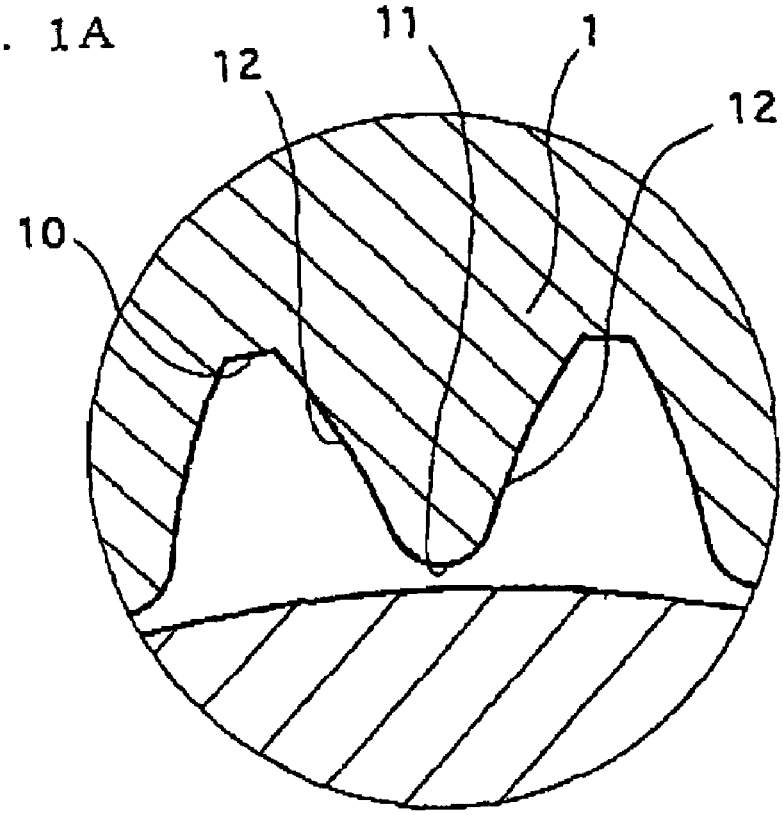
FIGS. 1A and 1B are cross sectional views on larger scale showing a relevant of the gear and the method and device for manufacturing the same according to the first embodiment of the present invention.

Hereinafter, embodiments of the present invention will be described using the drawings.

First Embodiment

As shown in FIGS. 1 to 5, in a method for manufacturing a gear according to the first embodiment, wherein the gear is formed on a forging process by a die 1 having an inner peripheral surface 10, on which a plurality of top surface 11 corresponding to a bottom surface of the gear and both projected side surfaces 12 corresponding to tooth surfaces thereof and sandwiching the top surface 11, connect smoothly each other, in which the tooth surfaces and the bottom surface of the formed gear connect to each other smoothly. The forging process is carried out on hot forging process in which the gear 2 is formed by the die 1 having the inner peripheral surface 10 including the plurality of the top surface 11 corresponding to the bottom surface 21 of the gear and the both projected side surfaces 12 corresponding to the tooth surfaces 22 thereof and sandwiching the top surface 11, and wherein the forging process is carried out on cold forging process in which the hot forged gear is formed by the die 1 having the inner peripheral surface 10 including the plurality of the top surface 11 corresponding to the bottom surface 21 of the gear and the both projected side surfaces 12 corresponding to the tooth surfaces 22 thereof and sandwiching the top surface 11.

Figure 2:
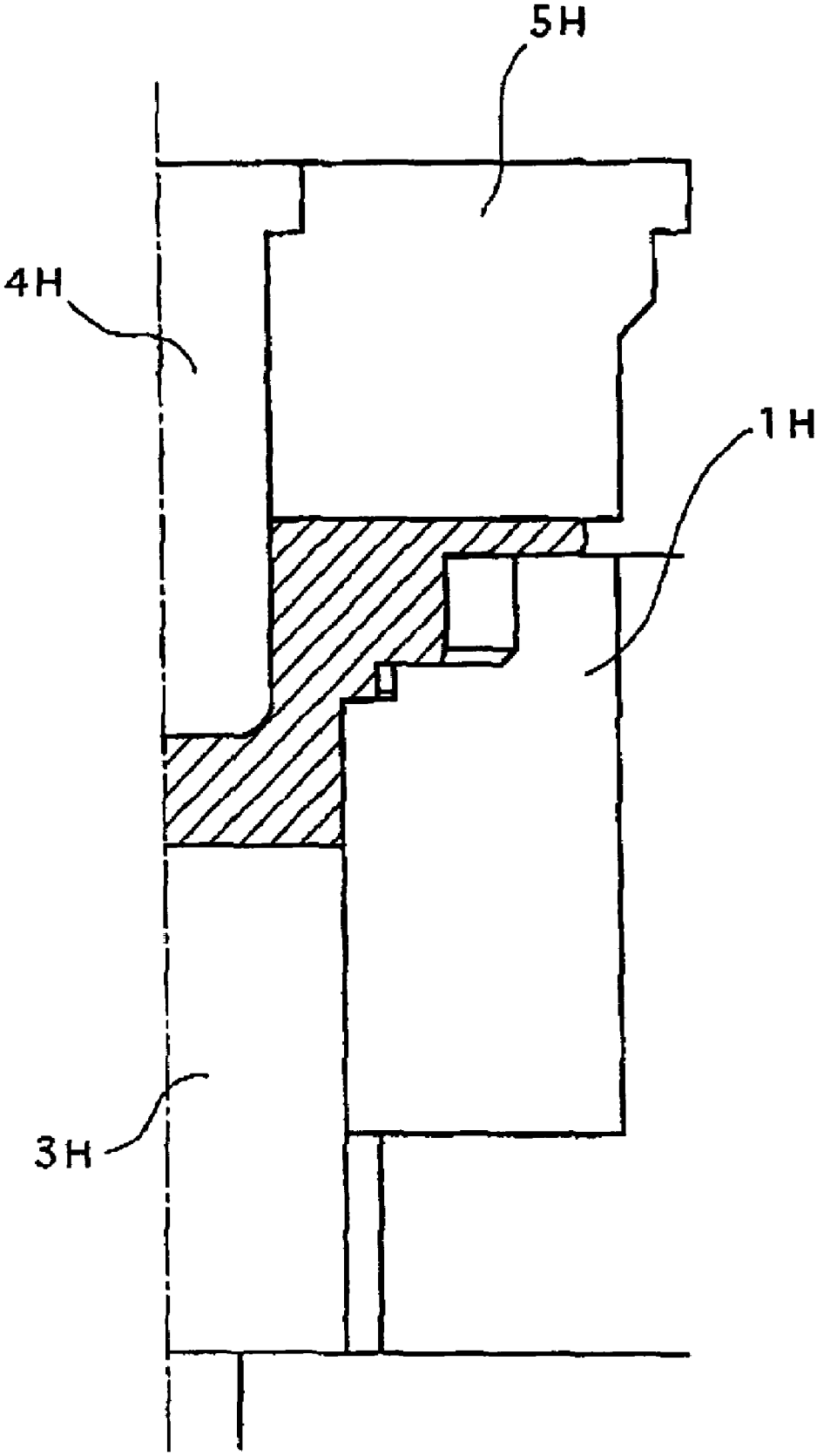
FIG. 2 is a longitudinal sectional view showing a relavant part of the hot forging device on gear and the method and device for manufacturing the same according to the first embodiment.

In the manufacturing device according to the first embodiment, a solid cylinder material as shown in FIG. 3A is depressed so that the solid cylinder material is formed of humilis disc-form material as shown in FIG. 3B. Next, in a preforging process, the flat disc-form material is forged on hot forging by a forging device including a die having an ejector 3H inserted inside a die 1H movably and an upper part punch 5H is provided at an outer peripheral part of the upper part of a mandrel 4H, as shown in FIG. 2, and is moved downward.

Figures 4A, 4B, 4C:
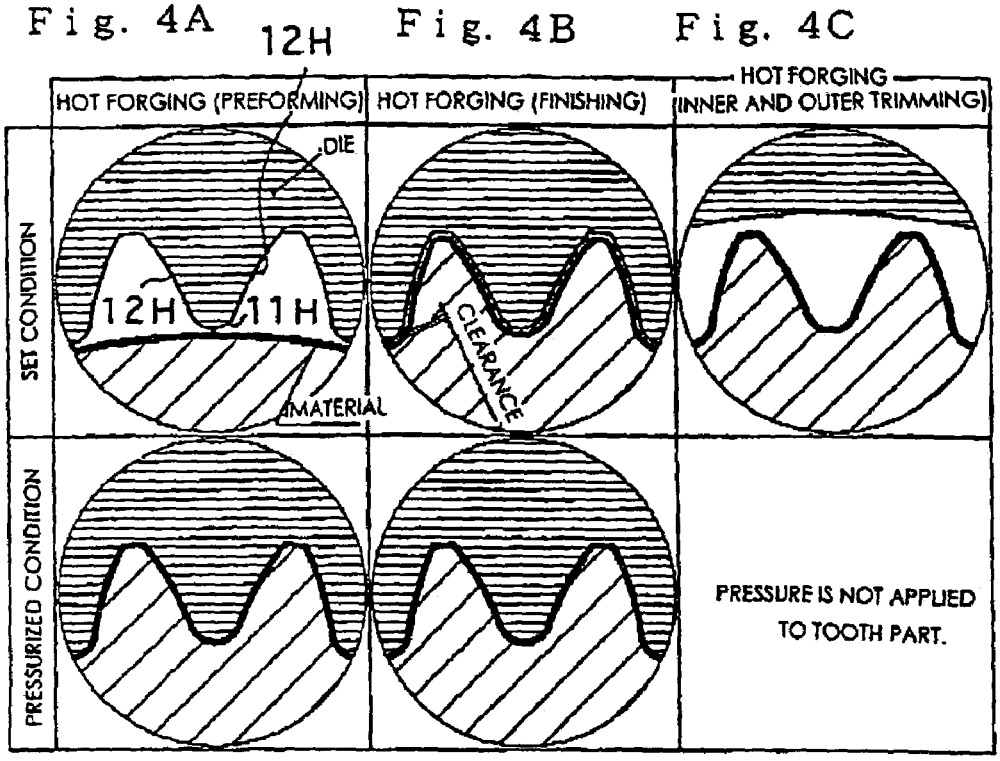
FIGS. 4A, 4B, 4C, 4D and 4E are explanation views showing before-and-after of the main process of the method for manufacturing the gear according to the first embodiment.

It follows that on hot forging, a flat disc-form material formed by depressing a solid cylinder material as shown in FIG. 3C and FIG. 4A is preformed by a die 1 having an inner peripheral surface 10 on which a plurality of top surface 11 corresponding to the bottom surface of the gear, and the both projected side surfaces 12 corresponding to the tooth surfaces of the gear, and sandwiching the top surface 11.

After the preforging process, as shown in FIG. 3D and FIG. 4B, the preformed material is finished on hot forging by the same device and die so as to obtain a gear material HS of hat shape having a finished tooth surface and the other finished parts.

After the finishing process, a center flat part CS and outer peripheral projected part OS of the finished gear material HS of hat shape are cut or trimed in hot forging by cutting or trimming dies as shown in FIG. 3E and FIG. 4C.

Figure 5:
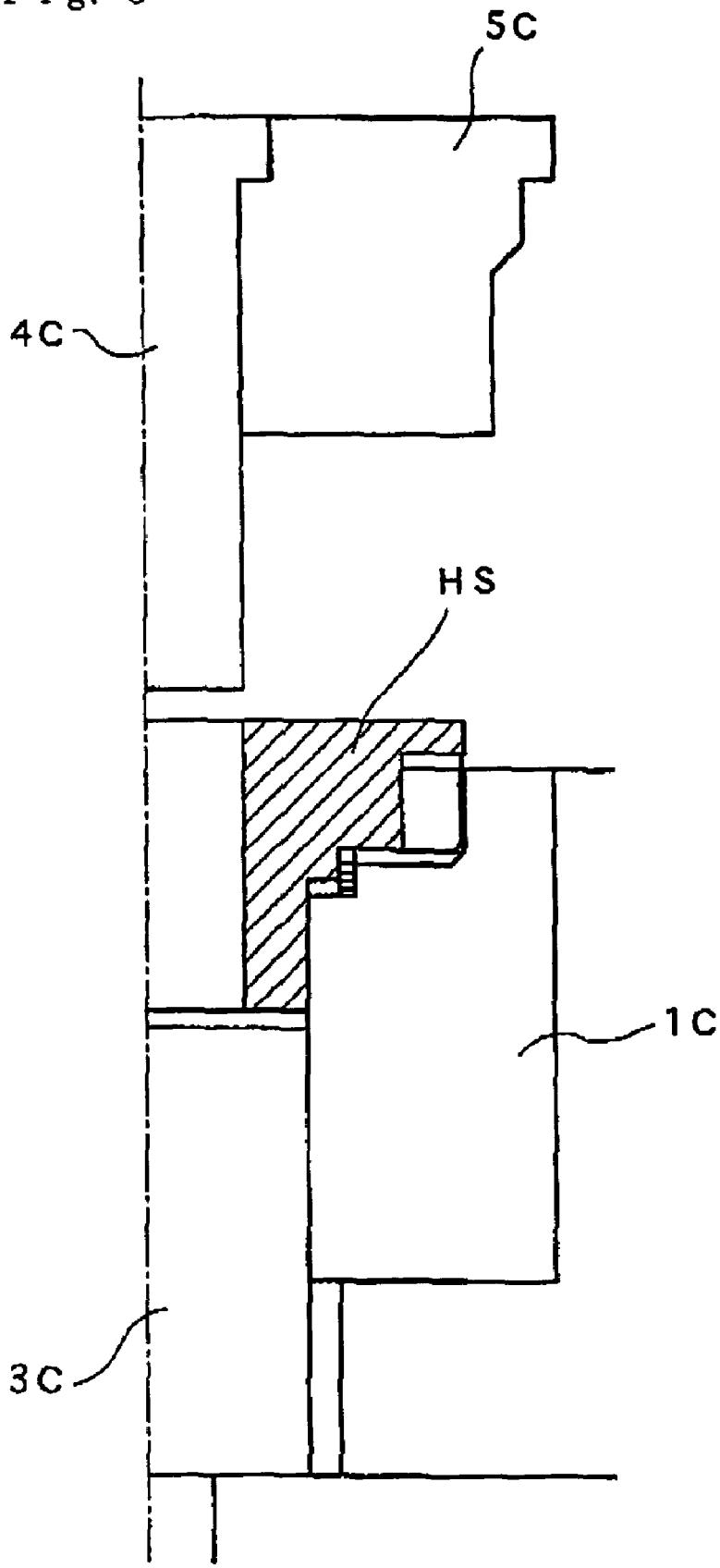
FIG. 5 is a longitudinal sectional view on larger scale showing a relevant part of the cold forging device on the gear and the method and device for manufacturing the same according to the first embodiment.

The gear material HS formed by triming the center flat part CS and the outer peripheral projected part OS on hot forging, is set on center concave portion comprising of the die 1C and the ejector 3C inserted inside the die 1C movably as shown in FIG. 5. Then, the gear material HS is forged on cold forging by a forging device in which the upper punch 5C provided on the outer peripheral surface of the mandrel 4C moves downward so as to forge the gear material HS.

Figures 4D, 4E:
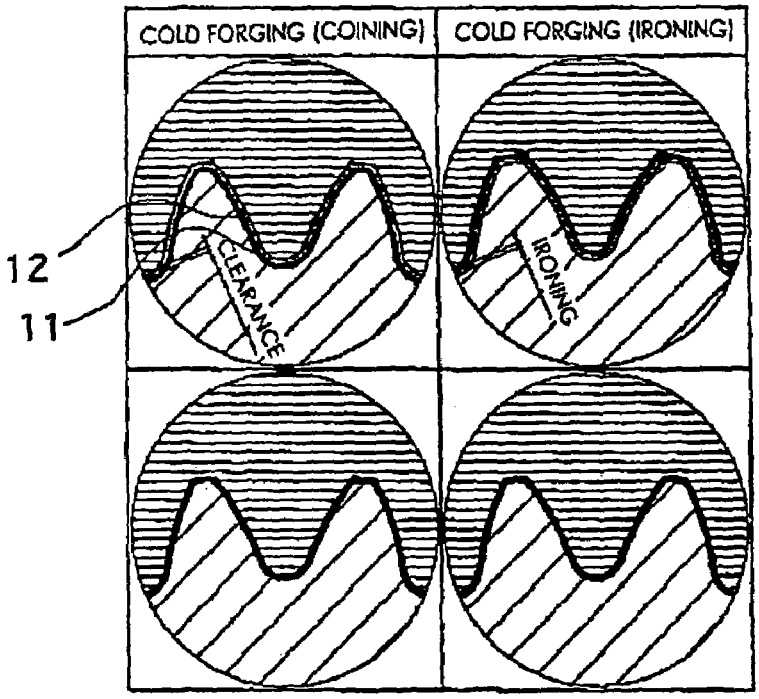

It follows that the gear material HS is forged on cold forging by coining as shown in FIG. 3(F) and FIG. 4(D) and ironing as shown in FIG. 3(G) and FIG. 4(E). The ironing process is carried out according to need and it is possible to abbreviate the ironing process in a case.

The first embodiment of the present invention may be applicable to methods for manufacturing each transmission gear having a helical gear formed at a outer peripheral part thereof used for a transmission for automobiles, a sprocket having a sprocket part for a chain at an outer peripheral part thereof, a locking unit having a trapezoidal tooth part at an outer peripheral part thereof, and helical gear and spur gear used for a reverse gear. In these cases, material is made by hot forging and the material is forged by normalizing or annealing. After normalizing or annealing the material formed on hot forging, the normalized or annealed material is treated by eliminating fine flaw and burr occurring on a surface of the material and the material and is formed on cold forging by coining. Finally, the material is finished by cutting back one side surface and both side surfaces and the finished material is heat treated heating. Moreover, in some cases, shot peening is carried out to the forged material so as to enhance the property of intensity more.

A shape and size of a die used on cold forging process is determined in consideration of deformation of the die due to forging pressure, spring back of forged product, oariation on shape of tooth form change in dimension due to heat treating distortion of measure.

In the gear, method for manufacturing the same and the device according to the first embodiment, wherein the gear is formed on the forging process by the die having the inner peripheral surface 10, on which the plurality of the top surface 11 corresponding to the bottom surface of the gear and the both projected side surfaces corresponding to tooth surfaces thereof and sandwiching the top surface 11 connect smoothly each other, and wherein the tooth surfaces and the bottom surface of the formed gear connect to each other smoothly. Therefore, it is able to prevent intensity of tooth root lowering, and to attain to manufacture the gear having property of high intensity and to lower costs of products and manufacturing costs, because there is no step formed at tooth root.

In the method for manufacturing a gear according to the first embodiment, preforging and finishing processed are previously carried out on the forging process by a die having the inner peripheral surface 10 on which a plurality of the top surface 11 corresponding the bottom surface of the gear and both projected side surfaces corresponding to tooth surfaces thereof and sandwiching the top surface 11. Therefore, it is able to prevent intensity of tooth root lowering, to lower costs of products and manufacture's costs, to manufacture a gear having a large diameter and a small diameter which differ greatly each other and to make a life of the die longer.

Moreover, in the method for manufacturing the gear according to the first embodiment, the gear material HS is formed on hot forging by preforming and finishing previously and the hot forged material is forged by coining and ironing on cold forging. Therefore, it is able to manufacture a gear having high accuracy and relative roughness of the surface.

In the deformation processing of the first embodiment, the spur gear used on the process for connecting the tooth tip and the tooth surface (for example, along the involute curved line) and the tooth surface and the bottom (for example, along the trochoid curved line) smoothly without occurring step parts has electrodes which are used for manufacturing a die and are formed by wire cut. Therefore, it is able to connect the tooth tip and the bottom of the spur gear smoothly.

On manufacturing a helical gear, electrodes are used for manufacturing a die and are formed by ball end mill. Therefore, it is able to connect the tooth tip and the bottom of the helical gear smoothly.

In the above described first embodiment, it is able to connect the tooth surfaces and the bottom surface of the gear smoothly. Therefore, it is able to avoid concentration of stresson the gear. Moreover, the first embodiment has advantages that it is able to enhance the intensity of tooth root, to enlarge an effective area of a tooth profile, and it is unnecessary to carry out semi topping process and there is no remained tool mark and pin corner.

In the first embodiment, the tooth profile of the gear and the shave R of the bottom and the tooth tip are freely determined by a shape of a die with freedom. Therefore, it is able to increase the freedom of design of the gear and in the case that the shape of the die is a shape which can avoid concentration of stress, it is able to enhance the intensity of the gear.

In the first embodiment of the present invention, in the case that shot peening is carried out so as to enhance the intensity of the gear more, the gear of the first embodiment differs from the gear formed by hobbing process on terms of residual compressive stress. In the forged gear manufactured by the innovative manufacturing method according to the first embodiment, it is able to lower costs, and it has advantages that intensity is high and there is no need for finishing process.

Second Embodiment

The gear and the method and device for manufacturing the same according to the second embodiment differ from the above described first embodiment in the respect that tooth part of a gear is formed on cold forging by a die having the inner peripheral surface, on which a plurality of the top surface corresponding the bottom surface of the gear and both projected side surfaces corresponding to tooth surfaces thereof and sandwiching the top surface connect smoothly each other. Hereinafter, the second embodiment will be described with a focus on differences.

In the second embodiment, the solid cylinder material as shown in FIG. 6(A) is depressed on hot forging process so as to flat disc-form material as shown in FIG. 6(B) Next, the material is forged on hot forging by the hot forging device used in the above described first embodiment.

It follows that the flat disc-form material formed by depressing the solid cylinder material as shown in FIG. 6(C) is preformed on hot forging process by a die having an inner peripheral surface so as to obtain the gear material HS of the horsehoe shape in cross-sectional view.

Next, a central flat part CS of the horsehoe shape gear material HS formed by preforging as shown in FIG. 6(D) is cut on hot forging by cutting or trimming process.

Figure 8:
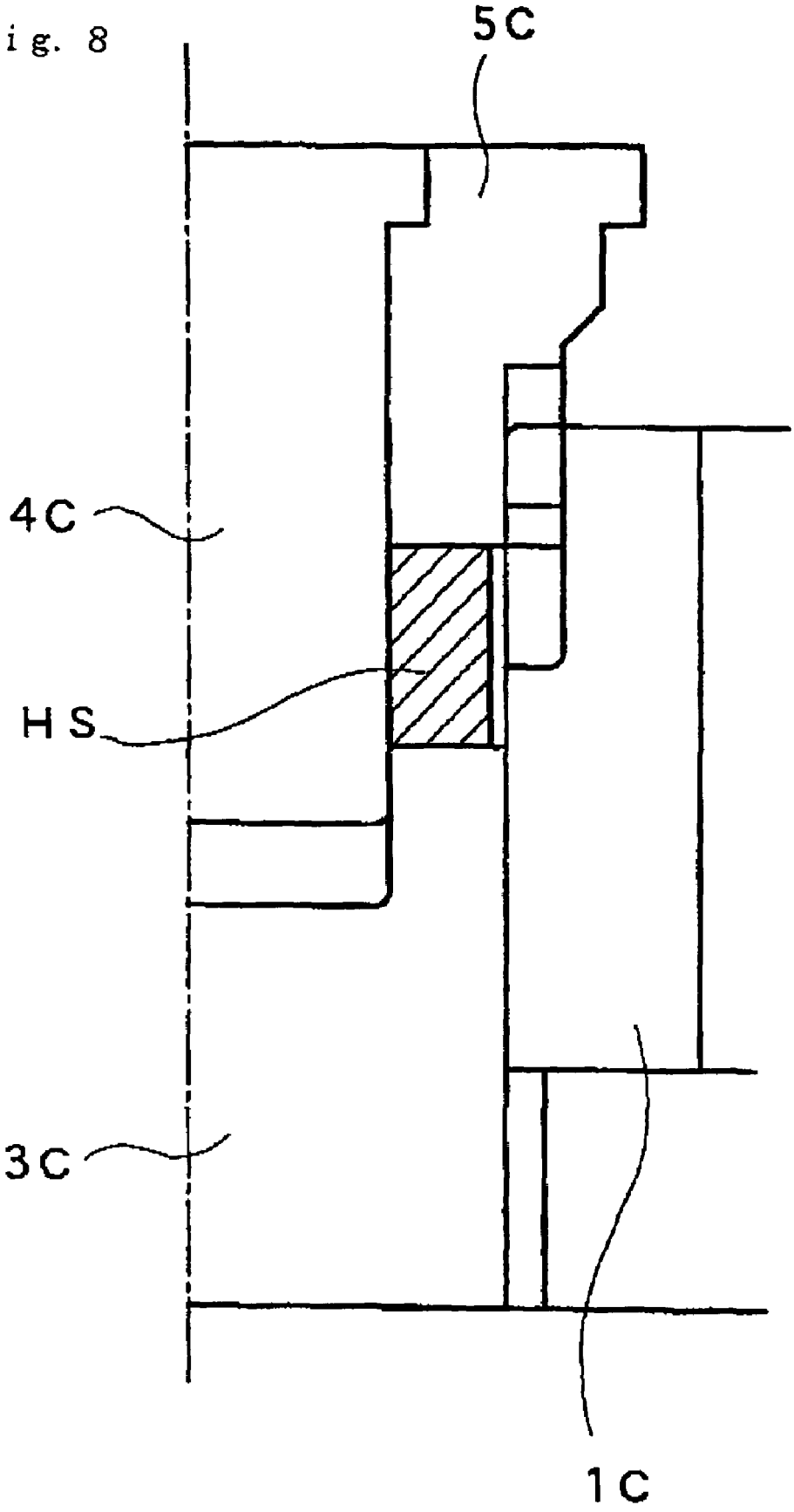
FIG. 8 is a longitudinal sectional view on larger scale showing a relevant part of the hot forging device on the gear and the method and device for manufacturing the same according to the second embodiment.

The annular gear material HS formed by trimming the center flat part CS on hot forging, is set on center concave portion comprising the die 1C and the horsehoe sectional ejector 3C provided inside the die 1C movably as shown in FIG. 8. Then, the annular gear material HS is forged on cold forging by bulging or punch stretch forming by a cold forging device in which the upper punch 5C, provided on the outer peripheral surface of the mandrel 4C having a bottom part provided in the central concave portion of the ejector 3C and the mandrel move downward so as to forge the gear material HS.

Figures 7A, 7B, 7C:
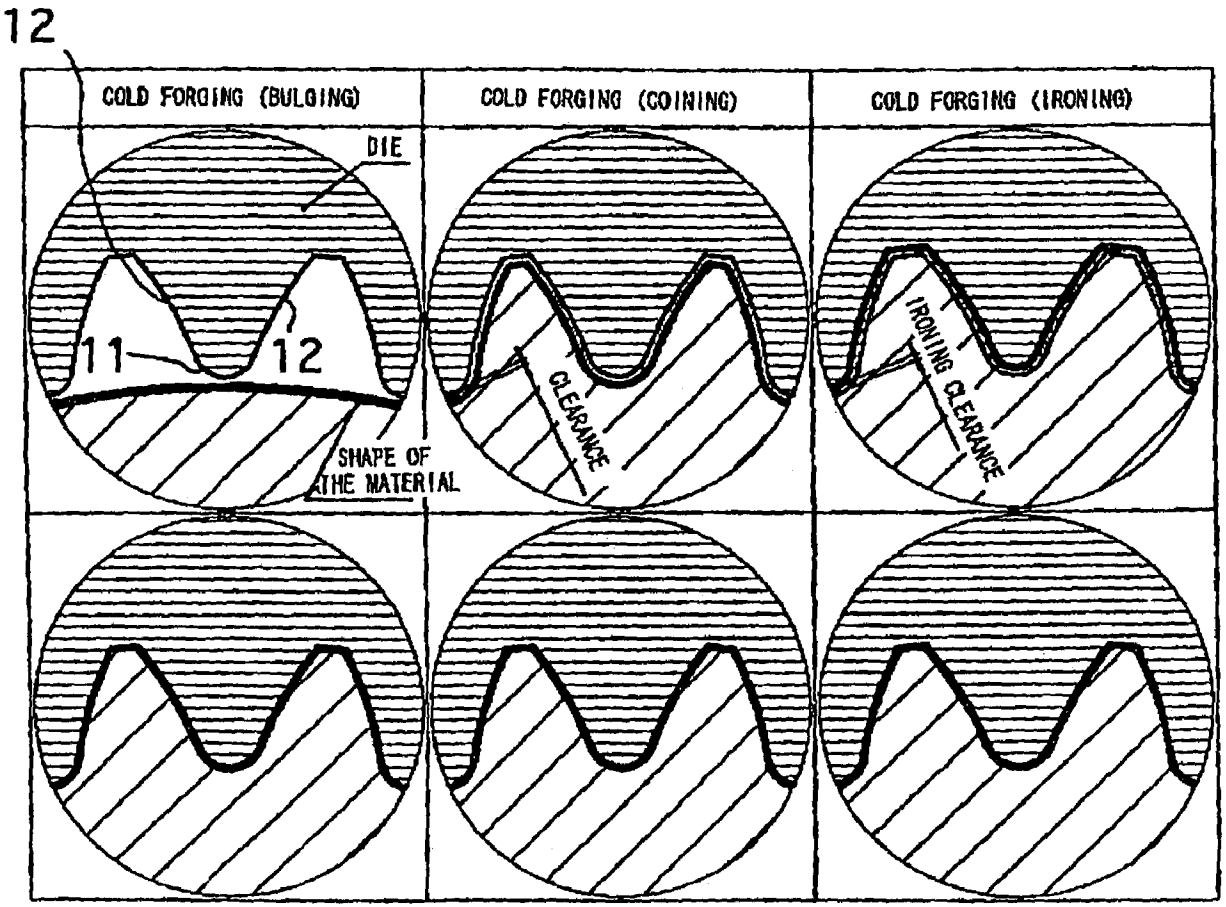
FIGS. 7A, 7B and 7C are explanation views showing before-and-after of the main process of the cold forging on the method for manufacturing the gear according to the second embodiment.

It follows that an outer peripheral part of the annular gear material HS is punched radially-outwardly on cold forging by bulging or punch stretch forming as shown in FIG. 6(E) and FIG. 7(A) so as to bulge or project in the radial outward direction and form a gear part.

Next, the gear material HS having a gear part formed by punch stretch forming as shown in FIG. 6(F) and FIG. 7(B) is forged by coining and ironing as shown in FIG. 6(G) and FIG. 7(C).

In a method for manufacturing a gear according to the second embodiment, the forging process is carried out on cold forging process in which the gear is formed by the die having the inner peripheral surface including the plurality of the top surface corresponding to the bottom surface of the gear and the both projected side surfaces corresponding to the tooth surfaces thereof and sandwiching the top surface connecting smoothly each other. Therefore, it is able to prevent the intensity of the tooth root lowering and to lower cost of products and manufacturing costs.

In the method for manufacturing the gear according to the second embodiment, the forging process is carried out on the cold forging process by punch stretch forming. Therefore, the method for manufacturing the gear according to the second embodiment is adapted to manufacturing the gear has small addendum such as a clutch gear and an idler gear having a large diameter and a small diameter which differ greatly each other, it is able to avoid intensity of tooth root lowering and to lower cost of products and manufacturing costs.

It follows that it is able to effectively restrain a breakdown of the gear due to concentration of stress by curved surface connecting smooth lines from the tooth root R to the tooth surface, and to achieve an improvement on the intensity of 30% because fiber flow is along tooth profile and the tooth root has dense structure by punch strech forming the gear in direction from the tooth root to the tooth tip.

In the second embodiment, it is able to obtain a product being plactical without finishing process by eliminating surface discontinuity of the annular gear material HS before the cold forging process.

Third Embodiment

Figures 10A, 10B, 10C:
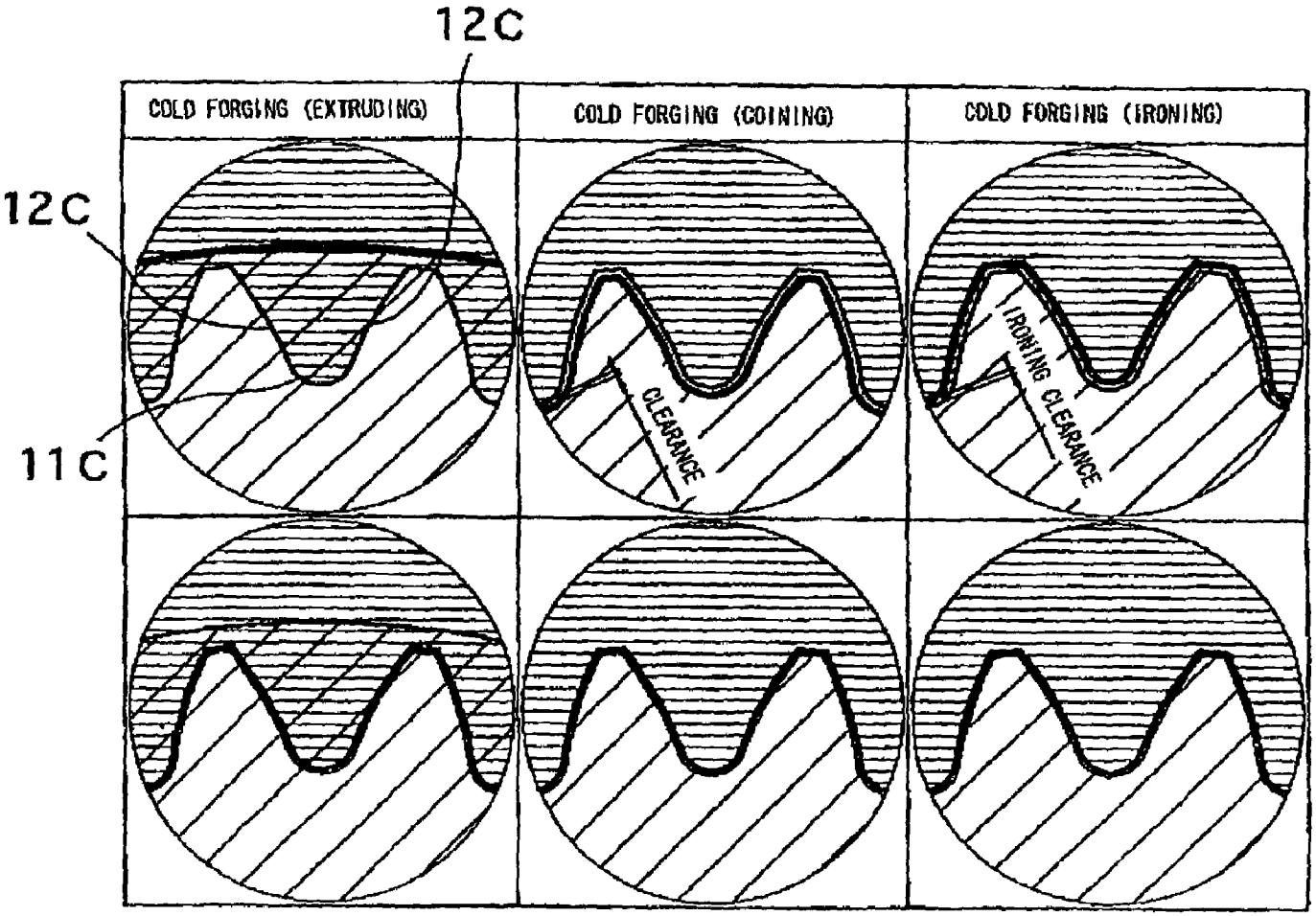
FIGS. 10A, 10B and 10C are explanation views showing before-and-after of the main process of the cold forging on the method for manufacturing the gear according to the third embodiment.
Figure 11:
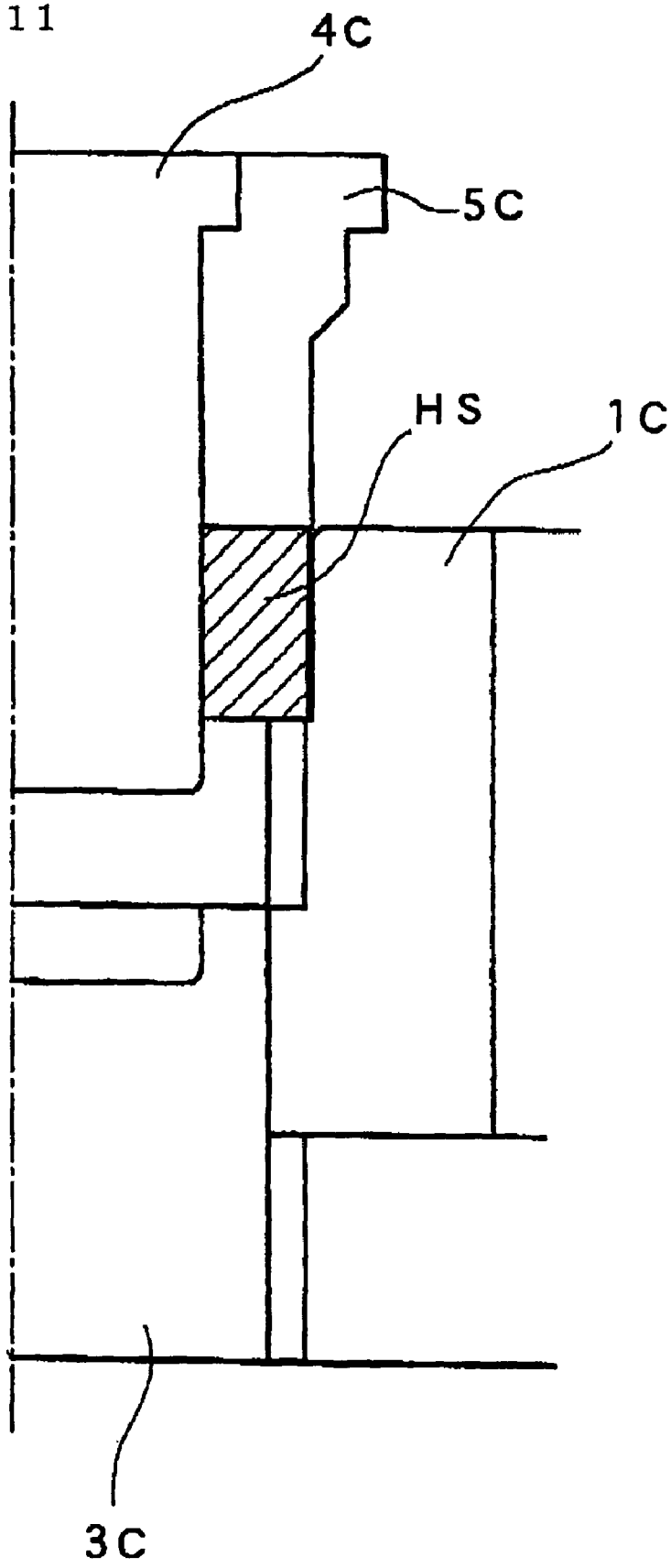
FIG. 11 is a longitudinal sectional view on larger scale showing a relevant part of the cold forging device on the gear and the method and device for manufacturing the same according to the third embodiment.

The gear and the method and device for manufacturing the same according to the third embodiment differ from the above described second embodiment in the respect that as shown in FIG. 9-11 tooth part of a gear is formed on cold forging by extruding by a die having the inner peripheral surface, on which a plurality of the top surface corresponding the bottom surface of the gear and both projected side surfaces corresponding to tooth surfaces thereof and sandwiching the top surface connect smoothly each other. Hereinafter, the third embodiment will be described with a focus on differences.

In the third embodiment, the solid cylinder material as shown in FIG. 9(A) is depressed on hot forging process so as to obtain a flat disc-form material as shown in FIG. 9(B). Next, the material HS is forged on hot forging by the hot forging device used in the above described first embodiment.

It follows that the flat disc-form material formed by depressing the solid cylinder material as shown in FIG. 9(C) is preformed on hot forging process by a die having an inner peripheral surface so as to obtain the gear material HS of the horsehoe shape in cross-sectional view.

Next, a central flat part CS of the horsehoe gear material HS formed by preforging as shown in FIG. 9(D) is cut on hot forging by cutting or trimming process.

Figure 1B:
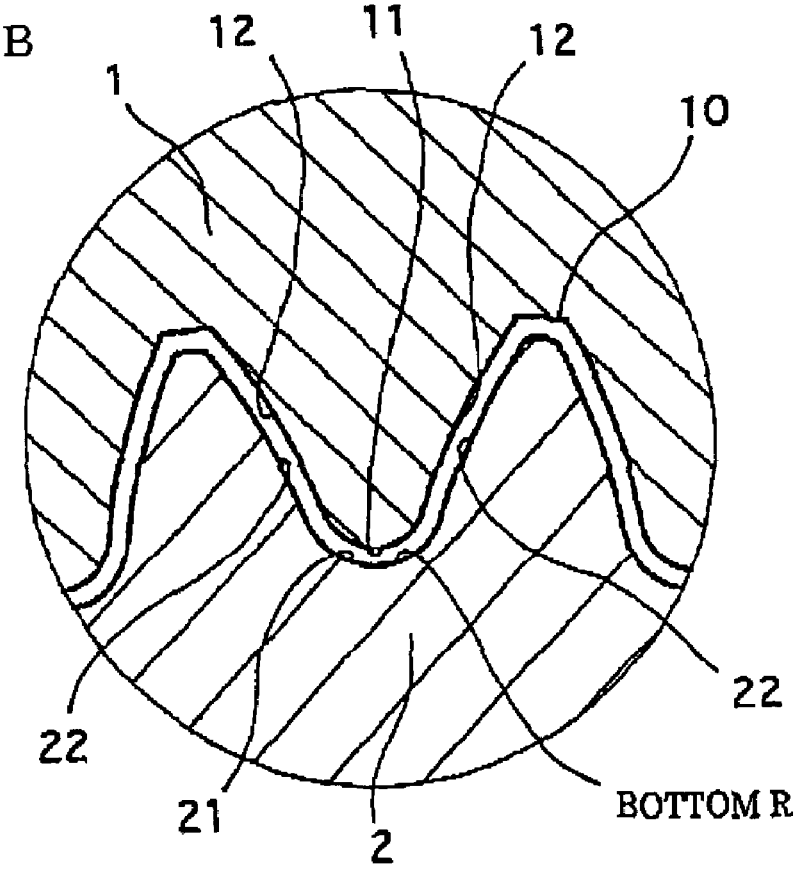

The annular gear material HS formed by trimming the center flat part CS on hot forging, is set on center concave portion comprising the die 1C and the horsehoe sectional ejector 3C provided inside the die 1C movably as shown in FIG. 1. Then, the annular gear material HS is forged on cold forging by extruding by a cold forging device in which the upper punch 5C provided on the outer peripheral surface of the mandrel 4C having a bottom part provided in the central concave portion of the ejector 3C and the mandrel 4C move downward so as to forge the gear material HS.

It follows that as shown in FIG. 9(E) and FIG. 10(A), an outer peripheral part of the annular gear material HS is reduced radially-inwardly and in result, the gear part is projected and formed.

Next, the gear material HS having a gear part formed as shown in FIG. 9(F) and FIG. 10(B) is forged by coining and ironing as shown in FIG. 9(G) and FIG. 10(C).

In a method for manufacturing a gear according to the third embodiment, the forging process is carried out on cold forging process in which the gear is formed by the die having the inner peripheral surface including the plurality of the top surface corresponding to the bottom surface of the gear and the both projected side surfaces corresponding to the tooth surfaces thereof and sandwiching the top surface connecting smoothly each other. Therefore, it is able to prevent intensity of tooth root lowering and to lower costs of products and manufacturing costs.

In the method for manufacturing the gear according to the third embodiment, the forging process is carried out on cold forging by extruding. Therefore, it is able to prevent intensity of tooth root lowering and to lower costs of products and manufacturing costs.

It follows that it is able to effectively prevent breakdown of the gear due to concentration of stress by curved surface connecting smooth line from the tooth root R to the tooth surface, and to achieve an improvement on the intensity of 30% because fiber flow is along tooth profile and the tooth root has dense structure by punch stretch forming the gear in direction from the tooth root to the tooth tip.

In the third embodiment, it is able to obtain a product being practical without finishing process by eliminating surface discontinuity of the annular gear material HS before the cold forging process.

Forth Embodiment

The gear and the method and device for manufacturing the same according to the forth embodiment differ from the above described second embodiment in the respect that a part of a die corresponding to the tooth surface sandwiching the tooth root of a gear, is formed of circular concave shape. Hereinafter, the fourth embodiment will be described with a focus on differences.

Figure 12A:
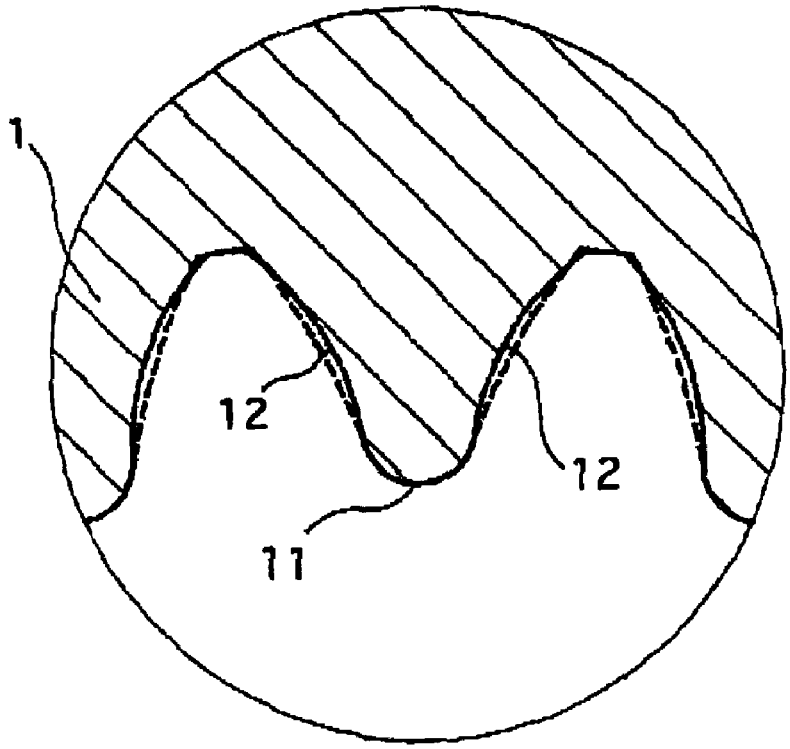
FIGS. 12A and 12B are cross sectional views on larger scale showing a relevant part of the gear and the method and device for manufacturing the same according to the fourth embodiment of the present invention.
Figure 12B:
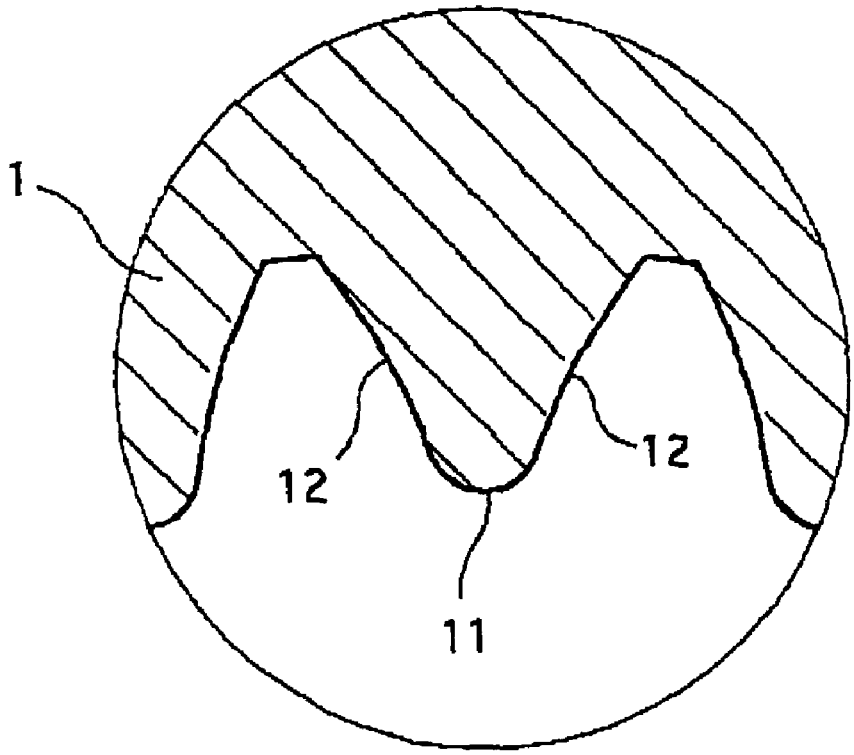

In the forth embodiment, as shown in FIG. 12(A), the tooth surface sandwiching the tooth root 11 of the gear is formed of circular convex shape on bulging in cold forging by a die having an inner peripheral surface formed of circular concave shape. Next, the tooth surface 12 is forged on coining process by a die having a tooth surface corresponding to final tooth profile as shown in FIG. 12B (broken line as shown in FIG. 12A). Therefore, it is able to obtain high density and relative surface roughness of the tooth surface 12 of the gear, because the tooth surface of the product is forged and hammered effectively due to difference between the shape of the two dies.

The density of the tooth surface 12 as a rolling intermeshing part is improved and in result, it is able to obtain high dense fiber flow and improve the intensity. Moreover, it is able to improve the intensity against breakdown begun at the tooth root part and the relative surface roughness and in result, it is difficult to occurr breakdown in the same lubricating condition and it is able to prevent pitching.

The preferred embodiments of the present invention, as herein disclosed, are taken as some embodiments for explaining the present invention. It is to be understood that the present invention should not be restricted by these embodiments and any modifications and additions are possible so far as they are not beyond the technical idea or principle based on descriptions of the scope of the patent claims.

Figure 13:
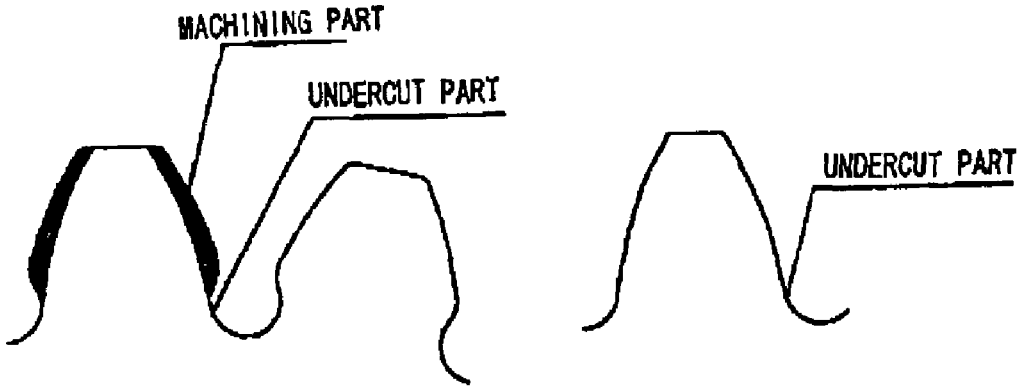
FIG. 13 is an explanation view showing the embodiment of the present invention in which the undercut part is formed on forging process.

In the above described embodiment, as an example, tooth surface is connected to the R part of the bottom smoothly. It is to be understood that the present invention should not be restricted by these embodiments and such embodiment that as shown in FIG. 13, an undercut part is formed at the bottom of the gear by forging and there is no step at the bottom so as to improve the intensity in the case that machining is carried out as after processing.

Figure 14A:
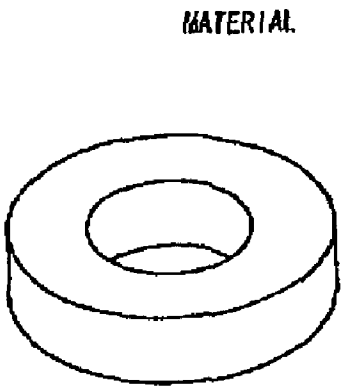
FIGS. 14A, 14B and 14C are explanation views showing the embodiment of the present invention in which the helical gear is formed on forging process.
Figure 14B:
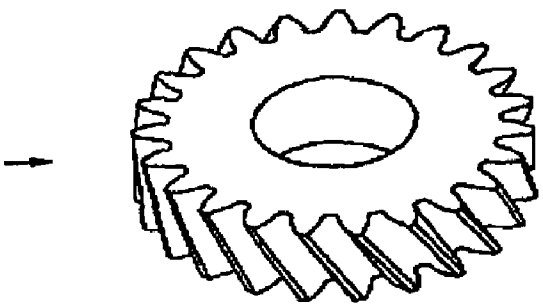
Figure 14C:
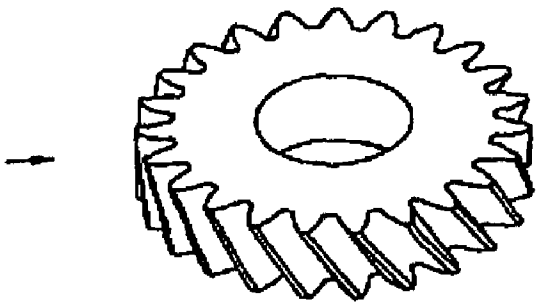
Figure 15A:
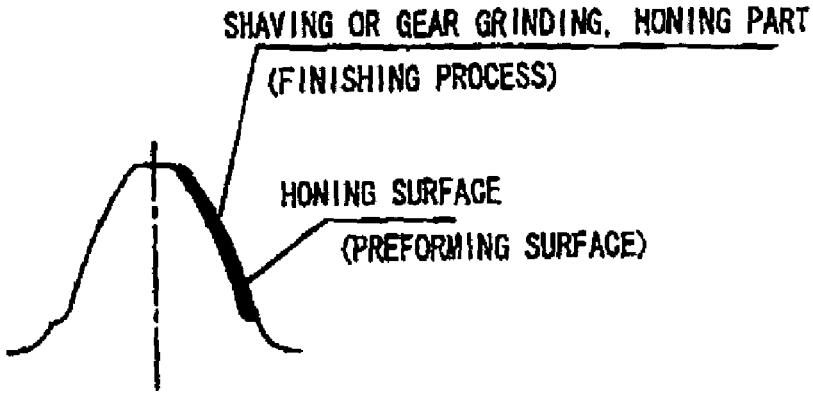
Fig. 15A (PRIOR ART)
FIGS. 15A and 15B are explanation views showing an example of a conventitionally formed gear tooth.
Figure 15B:
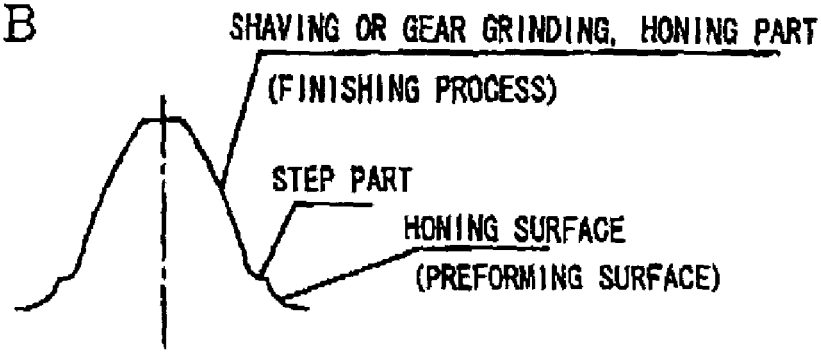

In the above described embodiment, as an example, the present invention is adapted to the spur gear. It is to be understood that the present invention should not be restricted by these embodiments and such embodiment that as shown in FIG. 14, the present invention is adapted to the helical gear and as an example, preforging is carried out on hot forging process and the finishing is carried out on cold forging. It is to be understood that the present invention should not be restricted by these embodiments and such embodiment that according to need, it is able to abbreviate the coining process on cold forging process.

In the above described embodiment, as an example, after the hot forging process, coining is carried out on cold forging process.

What is claimed is:

1. A method for manufacturing a gear, wherein said gear is formed in a forging process by a first die having an inner peripheral surface on which a plurality of top surfaces corresponding to a bottom surface of said gear and projected side surfaces, corresponding to tooth surfaces thereof and sandwiching said top surface, connect smoothly to each other, said tooth surfaces and said bottom surfaces of said formed gear connect to each other smoothly, and wherein projected tooth surfaces of said formed gear are initially formed by movement of a first die having an inner peripheral surface to form a projected tooth profile compared with a final tooth profile of said gear, said inner peripheral surface of said first die has a concave part radially concave at a central part between parts of said inner peripheral surface corresponding to a tooth root side part and a tooth tip side part of said near tooth surface, and said projected tooth surfaces of said gear are finally formed by a second die having an inner peripheral surface configured to form final tooth surfaces of said gear corresponding to a final tooth profile of said gear.

2. A method for manufacturing a gear according to claim 1, wherein said forging process is carried out in a hot forging process.

3. A method for manufacturing a gear according to claim 1, wherein said forging process is carried out in a cold forging process.

4. A method for manufacturing a gear according to claim 2, wherein said forging process is carried out by preforming hot forging.

5. A method for manufacturing a gear according to claim 3, wherein said forging process is carried out by extrusion in cold forging.

6. A method for manufacturing a gear according to claim 3, wherein said forging process is carried out by bulging in cold forging.

7. A method for manufacturing a gear according to claim 1, wherein an under cut part on said bottom surface of said gear is formed in said forging by said first die having a top surface formed at a corresponding part thereon, and projected parts of said projected tooth surfaces are carried away by machining after processing in order to obtain said tooth surfaces and said bottom surface of said gear connected to each other smoothly.

8. A method for manufacturing a gear according to claim 1, said projected side surfaces of said first die corresponding to said tooth surface of said gear formed by forging are formed respectively along an involute curve.

9. A method for manufacturing a gear according to claim 8, said top surface of said first die corresponding to said bottom surface of said gear formed by forging is formed along at least one selected from group of the trochoid curve, arc shape and the combination of the straight shape and arc shape.

10. A method for manufacturing a gear according to claim 1, wherein said concave part at said central part of said inner peripheral surface on said first die is circular in shape.

11. A method for manufacturing a gear according to claim 10, wherein a curved surface on a convex curved tooth surface of said gear is finally formed by punching on said forging process by a die having a curved surface to form said final tooth profile of said gear formed at a corresponding part thereon.

* * * * *